United States Patent [19]

Raisin et al.

[11] 4,381,068

[45] Apr. 26, 1983

[54] CONTINUOUS METHOD AND DEVICE FOR MAKING A SLEEVE WITH A TURNED BACK EDGE

[75] Inventors: Jean-Pierre Raisin, Troyes; Jacques Pion, Saint Julien les Villas, both of France

[73] Assignees: Institut Textile de France; Agence Nationale de Valorisation la Recherche, both of Paris, France

[21] Appl. No.: 233,039

[22] Filed: Feb. 9, 1981

[30] Foreign Application Priority Data

Feb. 8, 1980 [FR] France ..... 80 02806

[51] Int. Cl.[3] ..... A41H 43/02

[52] U.S. Cl. ..... 223/2; 223/39; 223/43

[58] Field of Search ..... 223/39, 42, 43, 2

[56] References Cited

U.S. PATENT DOCUMENTS

| | | | |
|---|---|---|---|
| 2,493,803 | 1/1950 | Butler | 223/39 |
| 2,898,021 | 8/1959 | Miles et al. | 223/43 X |
| 3,532,258 | 10/1970 | Kienel | 223/43 |
| 3,887,120 | 6/1975 | Harrill | 223/43 |
| 3,924,785 | 12/1975 | Diacont et al. | 223/2 |
| 3,991,919 | 11/1976 | Hogan | 223/39 |
| 4,281,781 | 8/1981 | Pope | 223/39 |

FOREIGN PATENT DOCUMENTS 1962993 12/1969 Fed. Rep. of Germany .

*Primary Examiner*—Louis Rimrodt

*Attorney, Agent, or Firm*—Bucknam and Archer

[57] ABSTRACT

The present invention relates to a continuous method and device for obtaining from a long length of tubular knitted element, a sleeve with a turned back edge.

The method consists in guiding the knitting by way of a tubular guide, with one end of said element projecting from the said guide, in turning back said projecting part by means of air jets and lateral gripping tongs, and in pulling forward the whole knitted element and cutting across the said element with a knife.

The invention finds a particular application in the production of garment elements or trimmings, such as wrist-bands for gloves, cuffs for sleeves or polar necks.

7 Claims, 18 Drawing Figures

FIG. 5
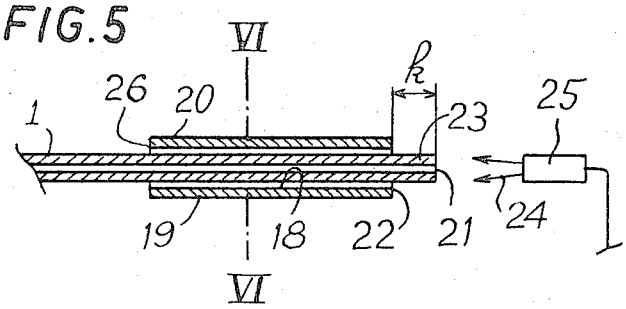
FIG. 6
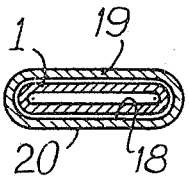
FIG. 7
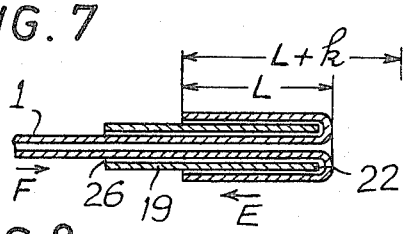
FIG. 9
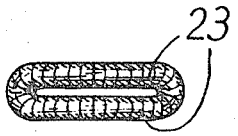
FIG. 8
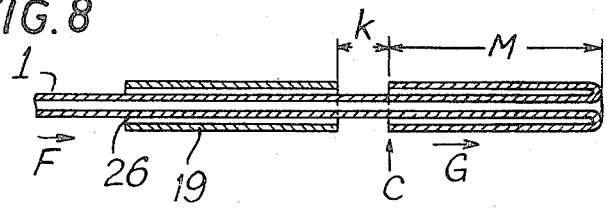
FIG. 11
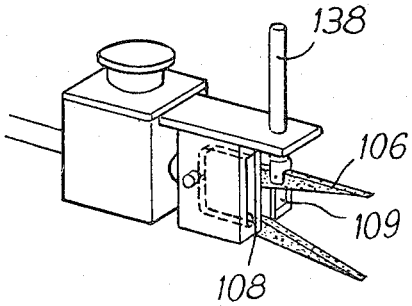
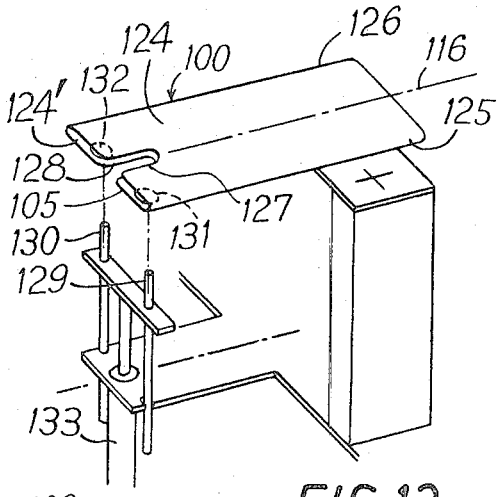
FIG. 12
FIG. 13
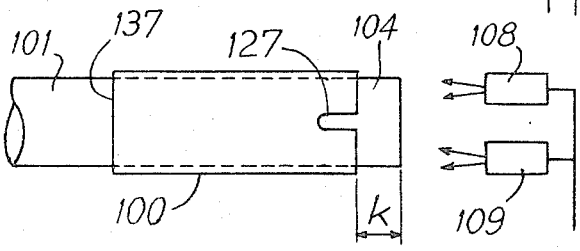

AV
AR

CONTINUOUS METHOD AND DEVICE FOR MAKING A SLEEVE WITH A TURNED BACK EDGE

The present invention relates to a continuous method to obtain, from a long length of tubular knitted element, a sleeve with a turned back edge.

It should be specified that the term tubular knitted element is used here for convenience's sake and in fact designates any supple and strong tubular surface whose physical qualities of stretchability and elasticity are similar to those of knitted textiles, independently of whether or not these qualities are the result of weaving or knitting operations, or of the molecular texture of the material used, as this is the case with certain varieties of rubbers and plastics.

Sleeves with a turned back edge are in the form of tubular elements, one edge of which has been turned back to form a fold either on the inside or on the outside of the sleeve. They are especially used in the clothing industry, where the turned back edge gives a neat border to the sleeves of a garment for example.

The turned back edge of such a sleeve can be used to hold, to hide or to protect added elements such as elastic bands, or reinforcing bands designed to be added on to the edges of said sleeves.

The predetermined dimensions of sleeves with a turned back edge which are required, are selected in relation to the intended use, bearing in mind that the required length of the turned back edge is always supposed to be less or equal to the given length of the sleeve.

In the special case, very important because of its applications, where the required length of the turned back edge is equal to the given length of the sleeve, the result is a band of double thickness.

Said bands of double thickness are of the known type and are used to make up garment elements. They are, for example, wristbands for gloves, ribbing-cuffs for sleeves of pull-overs or anoraks, polar necks which are sewn on to the garment in question; or else double-thickness ski hats made up by gathering and sewing the upper edge of the band or double sleeve.

Up to now, the production of sleeves with a turned back edge and of double-thick bands has been virtually unmechanized. For example, to obtain a double band from a length of tubular knitted element whose diameter varies according to the use that will be made of the said band, said length of knitted element is cut into sections of length equal to twice the length of the desired band; each section being thereafter turned over manually to form a double-thick band.

In the mass production of garments calling on the use of such sleeves with a turned back edge, the production by hand of the latter mobilizes staff who could be employed on other tasks, and thus reduces the output per hour of the production line, whilst increasing the running expenses.

However, a device is known from West German patent No. 1,962,993 wherein a tubular element is placed on the surface of a tubular guide so that its free end at the front is projecting; the projecting part of the knitted fabric is turned back on the inner surface of the said tubular guide, and this by means of a ram which is sunk into the said tubular guide. The whole knitted element is drawn towards the front and cut.

Such a device has a number of disadvantages. For example, it is quite impossible to use it to produce a long turned back edge as it would be difficult, if not impossible, to ram in a long length of knitted element projecting at the front of the guide (as jamming could occur).

Also, the way in which the guide is mounted can give rise to many problems: indeed, this guide is supposed to remain stationary solely by gravity (it is heavy) when the knitted element is pulled upwards. It is obviously very difficult to obtain this without the knitted element being perturbed: indeed, if the guide is actually quite heavy, it presses the knitted element strongly against the rollers, and said knitted element is deformed when pulled upwards, with the added risk of the cutting being irregular and of obtaining double bands with two thicknesses of different length. If the guide is not heavy enough there is a risk that it will be carried up with the ascending fabric, this preventing the performance of the method. Of course, the stretchability of the knitted fabric plays a large part, this complicating matters even further.

Finally, the known device is exclusively used to produce double bands whose two thicknesses are, theoretically, of equal length.

An apparatus is also known from U.S. Pat. No. 3,924,785, which is designed to make hems, using pivoting tongs. Said apparatus however does not permit to produce sleeves with a turned back edge, from a tubular knitted element.

It is the object of the present invention to create a method and device permitting to produce mechanically from a long length of tubular knitted element, a sleeve with a turned back edge of given length, and this without any of the disadvantages found in the prior art.

More specifically, the invention proposes a method and device permitting to cut sleeves outright, of which sleeves the external turned back edge can be shorter than the actual sleeve, without any risk of jamming occurring.

Using a method consisting in guiding one end of the length of tubular knitted element over one of two surfaces of a tubular guide defining an inner surface, so that the free front end of the said length of tubular knitted element projects from the front end of the said tubular guide by a predetermined length; in turning back on the other surface of the said tubular guide, the part of knitted element projecting at the front end of the said guide so as to form the turned back edge of the sleeve, and this until the second thickness thus turned over reaches the required length of the turned back edge; and in pulling the whole knitted element forward on the said tubular guide over a length at least equal to the given length of the sleeve, increased by the predetermined length; and finally in cutting across the tubular knitted element at the place defined by the given length of the sleeve, the method according to the invention is characterized in that the tubular knitted element is guided by the inner surface of the tubular guide and in that it is turned back over the outer surface of said guide. This method eliminates the need for specialized staff to produce these sleeves with a turned back edge. The production output is speeded up and the running costs are reduced by a mechanization of the manufacture involving the continuous production of the said sleeves.

This method also ensures a more uniform quality of the sleeves produced this way compared with the sleeves produced manually.

According to one characteristic of the invention, at least one air jet is used which is situated at the front end of the tubular guide and directed towards the back thereof and on to the portion of tubular knitted element projecting from the front end of the said tubular guide, in order to prepare the turning back of the edge of the said element.

According to a preferred embodiment of the method, the tubular knitted element is guided by the inner surface of the tubular guide, so that the free front end of the said tubular knitted element projects from the front end of the tubular guide by a predetermined length, preferably between 10 and 15 mm. One air jet at least is used which is directed on to the front part of the tubular knitted element so as to separate the lips formed by the said front part. Once separated, the lips at the front end of the knitted element are gripped and pulled towards the back of the tubular guide and towards the outside of said guide until the required length of the turned back edge is obtained, then the turned back element is released. The whole knitted element is pulled forward over a length equal to the length of the sleeve, increased by the predetermined length which is preferably between 10 and 15 mm, then the knitted element is cut across at the part defined by the required length of the sleeve; once produced this way, said sleeve can be stocked up or directed towards another stage in the production line.

The device permitting to obtain, from a long length of tubular knitted element, a sleeve with a turned back edge of given length, comprises a tubular guide which defines an inner surface and an outer surface one of which is used to guide the tubular knitted element, means for turning back a part of the tubular knitted element which projects from the front end of the tubular guide, means for pulling forward the whole knitted element, and means for cutting across said knitted element. Said device is characterized in that the inner surface of the tubular guide is provided for guiding the tubular knitted element and in that the means for turning back a part of the said tubular knitted element are adapted to turn the said part over the outer surface of the tubular guide.

The invention will be more readily understood on reading the following description with reference to the accompanying drawings in which:

FIGS. 5, 7 and 8 are longitudinal cross-sections of the tubular knitted element and of the tubular guide in three stages of an embodiment of the method according to the invention: before the turning-over operation, during the turning-over operation, and before the cutting operation;

FIG. 6 is a cross-section VI—VI of FIG. 9;

FIG. 9 is a view of the lips at the front end of the tubular knitted element;

FIG. 10 is a view from above of a device according to the invention;

FIG. 11 is a back perspective of the middle gripping tongs and of the nozzles of the device of FIG. 10;

FIG. 12 is a back perspective of the tubular guide of the device shown in FIG. 14;

FIGS. 13 to 18 are diagrammatical views from above of the device of FIG. 10, at different stages of its operation;

Figures 10, 14, 15, 16:
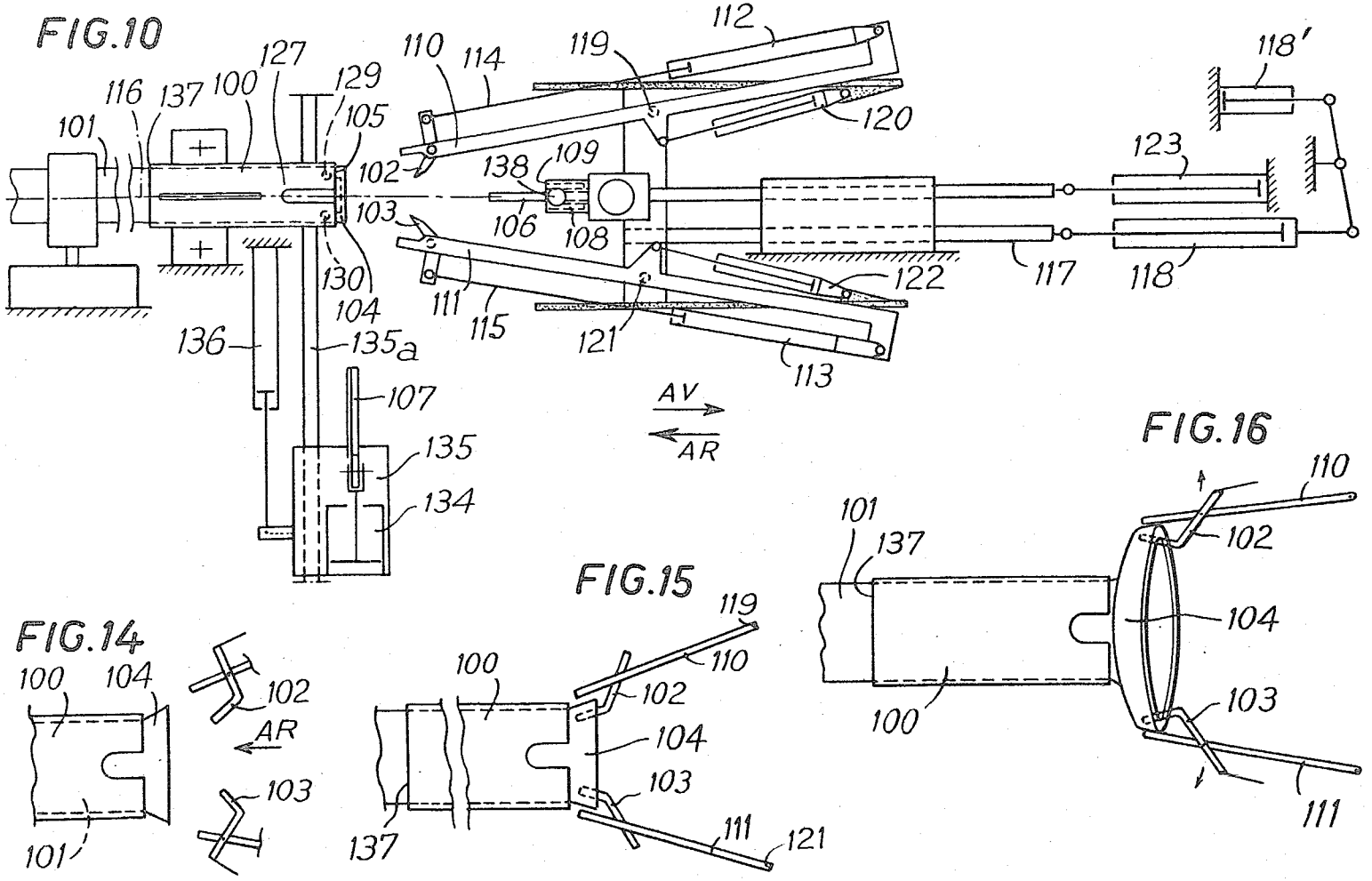
Figure 17:
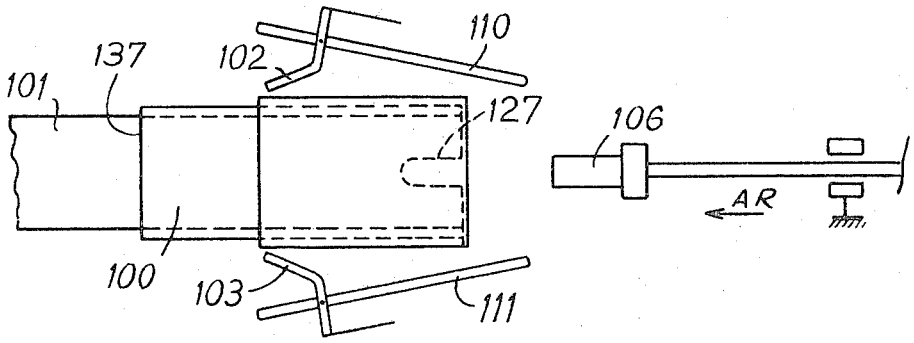

FIG. 13: jet of compressed air to separate the lips;

FIG. 14: bringing forward of the lateral gripping parts:

FIG. 15: closure of lateral gripping tongs;

FIG. 16: crosswise separation of the lateral tongs;

FIG. 17: turning over of the tubular knitted element; and

Figure 18:
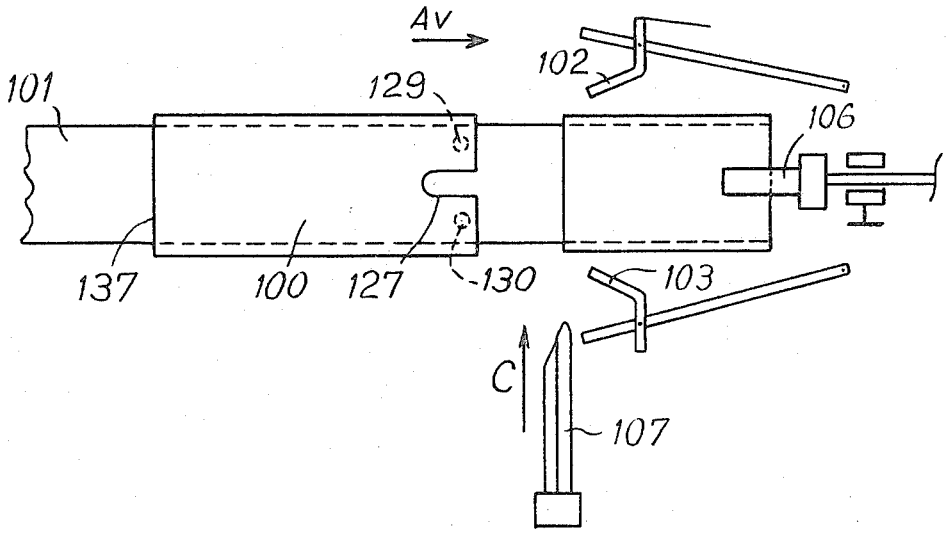

FIG. 18: advance of the tubular knitted element.

Figure 1:
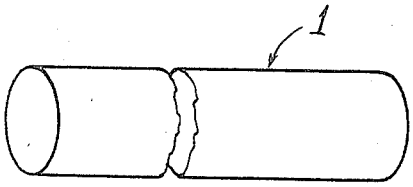
FIG. 1 shows a perspective view of a long length of tubular knitted element as used in the invention.
Figure 2:
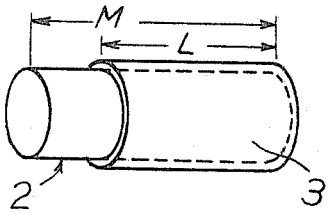
FIG. 2 is a perspective view of the sleeve with a turned back edge.

The method and device according to the invention are designed to obtain, from a long length of tubular knitted element 1, a sleeve 2 of given length M, with a turned back edge 3 of required length L, as shown in FIGS. 1 and 2.

Figure 3:
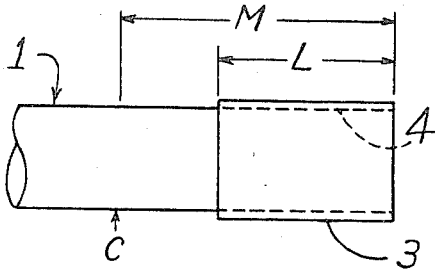
FIGS. 3 and 4 are front views of the tubular knitted element turned over on the outside, and of the sleeve with turned back edge.
Figure 4:
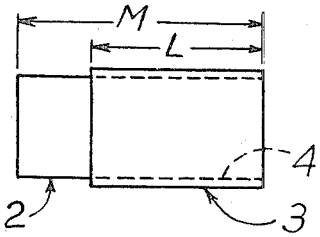

One of the steps in the method consists in obtaining a very long element one end of which is turned over a length L equal to that of the turned back edge to be produced, and in cutting across the said tubular knitted element at the place defined by the given length of the sleeve and indicated by the arrow C in FIG. 3, so as to form the sleeve 2 of FIG. 4.

The turned back edge 3 of the knitted element is situated above the thickness 4 as shown in FIGS. 3 and 4.

According to a preferred embodiment of the invention (FIGS. 5 to 9) the tubular knitted element 1 is guided by the inner surface 18 of a tubular guide 19 with a view to turning it over the outer surface 20 of the guide 19.

One end of the tubular knitted element 1 is guided over the inner surface of the tubular guide 19 in such a way that the free end 21 at the front of the tubular knitted element 1 projects from the front end 22 of the tubular guide 19 over a predetermined length k which can be between 0 and the required length L of the turned back edge.

The front edge of the front part of the knitted element 1 projecting from the tubular guide by a predetermined length k, forms lips 23 whose configuration is tied to the configuration of the tubular guide.

At least one air jet 24 (FIG. 5) produced by at least one nozzle 25 situated at the front of the tubular guide and of the tubular knitted element, and directed on the front part of the said knitted element 1, prepares the turning over by separating at least partly the lips 23 in order to make them easier to grip (FIG. 9).

The lips 23 of the front part of the knitted element are then gripped, and pulled towards the back 26 of the tubular guide, in the direction of arrow E of FIG. 7, and on the outside of said guide, over a length equal to the required length L of the turned back edge, increased by the predetermined length k.

During this movement, the remaining part of the tubular knitted element 1 moves forward (arrow F) over a length equal to L−k. The lips of the turned over knitted element are then released.

The whole knitted element is then pulled forward in the direction of arrow G in FIG. 8, over a length equal to the length M of the sleeve, increased by the predetermined length k by which the end of the tubular knitted element will project from the front end of the tubular guide before being turned over. There only remains to cut across the tubular knitted element at the place defined by the given length of the sleeve (arrow C of FIG. 8) to form a sleeve which can be stocked up or else taken towards another step in the production line.

The remaining tubular knitted element 1 projects by the predetermined length k permitting to start another cycle of turning over by separation of the lips, pulling of the lips towards the back, pulling forward of the whole knitted element, cutting, and so forth.

FIGS. 10 to 18 illustrate an embodiment of a device for obtaining, from a long length of tubular knitted element, a sleeve with turned back edge of given length, using the method described hereinabove.

The device according to the invention comprises a fixed tubular guide 100 defining an inner surface and an outer surface one of which is used to guide the length of tubular knitted element 101 coming from a preceding step in the production line; means 102/103 for turning back a part of tubular knitted element 104 projecting from the front end 105 of the tubular guide 100; means 106 for pulling forward the whole tubular knitted element 101, in the direction Av of FIG. 10; and means 107 for cutting across the said tubular knitted element 101. Said device further comprises at least one nozzle, such as nozzles 108 and 109, sending a jet of air and cooperating with the means 102/103 for turning back the part of tubular knitted element which projects from the front end of the tubular guide.

The means for turning back the said part 104 of tubular knitted element consist in two pairs of lateral gripping tongs 102 and 103 pivotally mounted on arms 110 and 111 and the opening and closing of which are controlled by double-acting jacks 112 and 113 mounted on said arms 110 and 111, whose action is transmitted by the rods 114 and 115. The tongs 102 and 103 are situated inside the middle plane of the tubular guide 100, which middle plane traverses the longitudinal axis 116 of the tubular guide 100, and is generally parallel to the largest diameter of a cross-section of the said guide. The tongs 102 and 103 are situated on either side of the said longitudinal axis 106 of the guide 100, and they are movable inside their plane, in parallel to as well as transversely of the longitudinal axis 116 of the tubular guide 100. To this effect, the said tongs 102 and 103 are mounted so as to be transversely movable and longitudinally fixed on a carriage 117 which is longitudinally movable owing to two double-acting jacks 118 and 118' mounted in series.

The arm 110 of the tongs 102 is adapted to pivot inside its plane about a pivot 119 of the carriage 117, thus causing the tongs 102 to move transversely under the action of a double-acting jack 120 whose cylinder is linked to the carriage 117 and whose rod is linked to the arm 110 of the tongs 102.

Likewise, the arm 111 of the tongs 103 is adapted to pivot inside its plane about a pivot 121 of the carriage 117, under the action of a double-acting jack 122 whose cylinder is linked to the carriage 117 and the rod is linked to the arm 110 of the tongs 103.

The means for pulling the whole tubular knitted element forward consist in middle gripping tongs 106 (FIG. 11) situated at the front of the tubular guide 100, preferably on the longitudinal axis 116 of the said guide, and movable in parallel to the said longitudinal axis 116 under the action of a double-acting jack 123. The middle tongs 106 are adapted to close and to open under the action of a double-acting jack 138.

Two nozzles 108 and 109 are placed laterally on either side of the tongs 106 and on the same support thereof, which nozzles are connected to a compressed air generator not shown. The two nozzles 108 and 109 are movable longitudinally with the middle gripping tongs.

The tubular guide 100 is flattened and has two parallel plane faces 124 and 124' joined together on their longitudinal sides by two substantially semi-cylindrical surfaces 125 and 126 (FIG. 13). At the front 105 of the tubular guide 100, the plane parallel faces 124 and 124' are provided with slots 127 and 128 situated in line with the middle tongs 106. Two fingers 129 and 130, whose movement is controlled by a jack 133, can penetrate the tubular guide 100 through orifices 131 and 132 provided on one of the plane faces of the said guide. The said fingers are designed to immobilize the tubular knitted element inside the tubular guide 100.

The means for cutting across the tubular knitted element comprise a pneumatic knife 107 whose closure and then opening are controlled by the jack 134. Said knife 107 is carried by a carriage 135 movable transversely on a slide **135*a* under the action of a double-acting jack 136**.

The FIGS. 13 to 18 illustrate the functioning of the device according to the invention using the method according to the invention from the position shown in FIG. 10.

The tubular knitted element 101 is placed inside the tubular guide 100, in such a way that a part 104 of said knitted element projects from the front end of the tubular guide by a predetermined length k. Said predetermined length k is preferably between 10 and 15 mm.

The nozzles 108 and 109 deliver jets of air on to the front part 104 of the tubular knitted element, in order to separate at least partly the lips formed by the said front part 104 of the knitted element (FIG. 13). The carriage 117 and as a result the tongs 102 and 103 move towards the back 137 of the tubular guide 100 (arrow Ar in FIG. 10) through the outlet of the jack 118' (FIGS. 10 and 14), this allowing the tongs to be in the right position to grip the separated lips of the front part 104 of the tubular knitted element (FIG. 15) and to close up by the retracting of the jacks 112 and 113. Due to the jack 133, the fingers 129 and 130 are released from the tubular guide 100 in order to allow the tubular knitted element 101 to move inside the guide 100. The tongs 102 and 103 move apart transversely, by pivoting their arms 110 and 111 under the action of the jacks 120 and 122, still gripping the lips of the tubular knitted element (FIG. 16). The carriage 117, when the jack 118 emerges, moves towards the back 137 of the tubular guide 100, carrying with it longitudinally the lateral tongs 102 and 103 and the end of the tubular knitted element along the outer surface of the tubular guide 100, for the turning over operation. The tongs 106 move longitudinally towards the back 137 (arrow Ar) when the jack 123 emerges. Before the tongs 102 and 103 have actually released the tubular knitted element over the tubular guide (FIG. 17), the tongs 106 have completed their displacement and have moved into the slots 127 and 128 of the tubular guide in order to grip all the thicknesses of tubular knitted element before closing up through the action of the jack 138. The tongs 106 start pulling the whole knitted element forward (arrow Av) through the retracting of the jack 123 just before the tongs 102 and 103 release the knitted element, this avoiding the formation of beadings. The carriage 117 returns to its initial position when the jacks 118 and 119 retract (FIG. 18). There only remains for the knife 107 to move forward to a cutting position, whilst the fingers 129 and 130 enter into the tubular guide 100 and immobilize the tubular knitted element and to cut across the tubular knitted element at the place defined by the length of the sleeve (arrow C), and then to resume its rest position. The tongs 106 then open and release the sleeve. The plane of the tubular guide and of the tongs is advantageously selected to be horizontal, so that the sleeve can drop by gravity, and be either stocked up; or taken to another step in the production line.

It will be noted that in FIG. 18, there is shown the special embodiment of a double-thick band, this explaining that the axis of the knife coincides with the length of the turned back edge, since in this particular case both the sleeve and the turned back edge have the same length.

It should also be added that nowhere in the foregoing description has the thickness of the tubular guide been considered, since this, in practice, is immaterial.

The invention is not limited to the description given hereinabove but on the contrary covers any modifications that can be made thereto without departing from the scope therefrom.

What is claimed is:

1. Device for obtaining from a long length of tubular knitted element a sleeve with a turned back edge of predetermined length of the type comprising a tubular guide which defines an inner surface and an outer surface one of which is used to guide the tubular knitted element, means for turning back a part of the tubular knitted element which projects from the front end of the tubular guide, means for pulling forward the whole knitted element, and means for cutting across said knitted element, wherein the inner surface of the tubular guide is provided for guiding the tubular knitted element and in that the means for turning back a part of the said tubular knitted element are adapted to turn the said part over the outer surface of the tubular guide wherein at least one nozzle producing a jet of air is provided, which nozzle cooperates with the means for turning back the part of the knitted element which projects from the front end of the tubular guide.

2. Device as claimed in claim 1, wherein the means for turning back the part of tubular knitted element which projects from the front end of the tubular guide comprise two pairs of lateral gripping tongs situated inside the middle plane traversing the longitudinal axis of the said tubular guide and being parallel to the largest diameter of a cross-section of the said guide, and wherein said tongs are situated on either side of the longitudinal axis of said guide and are movable inside their plane in parallel as well as transversely to the longitudinal axis of the fixed tubular guide.

3. Device as claimed in claim 2, wherein the lateral gripping tongs are mounted so as to be longitudinally movable and transversely fixed on a carriage which is longitudinally movable.

4. Device as claimed in claim 1, wherein the means for pulling forward the whole tubular knitted element comprise middle gripping tongs situated at the front of the tubular guide and movable in parallel to the longitudinal axis of the said tubular guide.

5. Device as claimed in claim 1, wherein the said tubular guide is provided at its front end with at least one notch.

6. Device as claimed in claim 1, wherein the said tubular guide is flattened and has two parallel plane faces joined together on their longitudinal sides by two substantially semi-cylindrical surfaces.

7. Device as claimed in claim 6, wherein two nozzles are provided, which nozzles are situated in the middle plane traversing the longitudinal axis of the tubular guide and parallel to its plane faces, and produce air jets directed towards the corners of the lips formed by the flattened part of the tubular knitted element projecting from the tubular guide.

* * * * *